US008516670B2

(12) United States Patent
Schatzmann

(10) Patent No.: US 8,516,670 B2
(45) Date of Patent: Aug. 27, 2013

(54) CARD FLAT REMOVAL DEVICE

(75) Inventor: Hans-Peter Schatzmann, Schweiz (CH)

(73) Assignee: Maschinenfabrik Rieter AG, Winterthur (CH)

( * ) Notice: Subject to any disclaimer, the term of this patent is extended or adjusted under 35 U.S.C. 154(b) by 583 days.

(21) Appl. No.: 12/745,314

(22) PCT Filed: Nov. 28, 2007

(86) PCT No.: PCT/CH2007/000598
§ 371 (c)(1),
(2), (4) Date: Oct. 25, 2010

(87) PCT Pub. No.: WO2009/067822
PCT Pub. Date: Jun. 4, 2009

(65) Prior Publication Data
US 2011/0203086 A1 Aug. 25, 2011

(51) Int. Cl.
*B23P 19/04* (2006.01)
*D01G 15/12* (2006.01)
*D01G 15/92* (2006.01)

(52) U.S. Cl.
USPC ..... 29/239; 19/113

(58) Field of Classification Search
USPC ..... 29/239; 19/98, 113, 114
See application file for complete search history.

(56) References Cited

U.S. PATENT DOCUMENTS

| | | | | |
|---|---|---|---|---|
| 397,265 | A * | 2/1889 | Ashworth et al. | 19/113 |
| 575,986 | A * | 1/1897 | Potter | 19/113 |
| 896,023 | A * | 8/1908 | Kasparson | 19/113 |
| 3,808,640 | A * | 5/1974 | Graf | 19/113 |
| 4,074,392 | A * | 2/1978 | Bechtel, Jr. | 19/113 |
| 4,295,248 | A * | 10/1981 | Beneke et al. | 19/113 |
| 5,095,585 | A * | 3/1992 | Grimshaw et al. | 19/113 |
| 5,755,012 | A * | 5/1998 | Hollingsworth | 19/114 |
| 6,101,680 | A * | 8/2000 | Naf et al. | 19/102 |
| 6,219,885 | B1 * | 4/2001 | Faas et al. | 19/98 |
| 6,687,958 | B2 * | 2/2004 | Wurst | 19/98 |
| 6,766,564 | B2 * | 7/2004 | Pferdmenges | 19/113 |
| 7,055,222 | B2 * | 6/2006 | Bischofberger et al. | 19/114 |
| 7,559,122 | B2 * | 7/2009 | Schatzmann et al. | 19/113 |
| 8,186,020 | B2 * | 5/2012 | Schatzmann | 19/104 |
| 2006/0230582 | A1 * | 10/2006 | Bischofberger et al. | 19/113 |

FOREIGN PATENT DOCUMENTS

DE 20 2006 016 614 U1 3/2007

OTHER PUBLICATIONS

International Search Report, Oct. 21, 2008.

* cited by examiner

*Primary Examiner* — Lee D Wilson
*Assistant Examiner* — Alvin Grant
(74) *Attorney, Agent, or Firm* — Dority & Manning, P.A.

(57) ABSTRACT

A method and a device for drawing off a clothing strip from a card-flat bar are presented. A clothing strip held on the card-flat bar by fastening means in the form of clips or clamps is released form the card-flat bar with the aid of a device resulting in at least partial opening of the fastening means. The device has a bearing face and a retainer for bearing on the card-flat bar or on the clip and has a spike for the at least partial opening of the clip.

11 Claims, 3 Drawing Sheets

CARD FLAT REMOVAL DEVICE

FIELD OF THE INVENTION

The invention relates to a device and a method for drawing off a clothing strip from a card-flat bar.

BACKGROUND OF THE INVENTION

Various types of construction of card-flat bars and various methods for fastening clothing strips to these card-flat bars are known from the prior art. The card-flat bars used currently on cards as revolving card flats are preferably equipped with flexible clothings. These clothings have a base or foundation built up from a plurality of fabric layers. The base holds small wire hooks which form the actual clothing elements. The clothings are manufactured in the form of strips. The strips correspond in length and width to the card-flat bars. These clothing strips are usually fastened to both longitudinal sides of the card-flat bar by fastening means in the form of clips or clamps. The clothing strip in this case lies on the underside of the card-flat foot. This bearing face of the card-flat foot has to satisfy high quality requirements in terms of its shape and dimensions. So that the required dimensional and positional tolerances for the bearing face can be fulfilled, the bearing face is normally covered with a compensating layer before the clothing strip is attached, or alternatively a mechanical machining of the bearing face may also take place.

SU 659 651 discloses a device for detaching a clothing strip from a card-flat bar (card flats clothing stripper). In this case, a knife is introduced between the clothing strip and the bearing face on the card-flat foot. The knife is drawn along the length of the card-flat bar and cuts or tears out the clothing strip between the lateral clips.

The operation is comparable to a peeling operation. Since the necessary forces for peeling out the clothing strip are high, when knives of this type are used manually, there is a high probability of the card-flat bar being damaged, whether by the card-flat bar being twisted or by the bearing face on the card-flat foot being impaired.

Similar designs of knives are also employed on card-flat detaching machines. The card-flat bars are tension-mounted in the machines, with the result that a twisting of the card-flat bar as a result of the detaching operation can be largely prevented. The disadvantage remains, however, that the bearing face on the card-flat foot is damaged by the knife. That part of the card-flat foot to which the clips are fastened may also be affected by the action of the force.

SUMMARY OF THE INVENTION

Objects and advantages of the invention are set forth in part in the following description, or may be obvious from the description, or may be learned through practice of the invention.

An object of the invention is to avoid disadvantages of the prior art and to make it possible to draw off the clothing strips of card-flat bars with as little effort as possible without a loss of quality to the card-flat bars.

In a particular embodiment, the device has, for bearing on a card-flat bar and/or on a clip, a bearing face and a retainer, as well as a spike or a batten for the partial opening of a clip (or other type of retaining means).

An embodiment of a device according to the invention is laid onto the card-flat bar or a clip. The card-flat bar in this case does not have to be tension-mounted, but may be held by hand or, for example, in a simple vice. The device is laid with its bearing face on the card-flat bar itself or on one of the two clips, depending on the type of construction of the card-flat bar. The device, when it is laid onto the card-flat bar or the clip, surrounds the card-flat bar at least partially and is hooked on the card-flat bar by means of a retainer. The retainer is adapted in its type of construction, shape and nature to the card-flat bar. Whether it is necessary for the retainer to engage around on the clothing side of the card-flat bar, with the exception of the side lying opposite the clip to be opened, depends on the type of construction of the card-flat bar. For hooking up the retainer, a projection present on the card-flat bar is used, which, depending on the type of construction of the card-flat bar, is at a greater or lesser distance from the bearing face of the device. The result of this is that the retainer is arranged so as to engage at least partially around the card-flat bar. By means of the retainer, the necessary retention force occurring during the opening of the clip can be introduced into the card-flat bar, without deforming or otherwise damaging the latter. After the device has been laid in place, a spike or a batten is applied via a lever to the clip to be opened. The spike has a shape which is coordinated with the clip to be opened. Preferably, the spike is designed as an elongate tapering batten. The spike is connected to the lever. By the lever being actuated, the spike is moved and consequently the clip is deformed. Owing to this deformation, the clip is opened or is stripped from the card-flat bar.

The device is built with a shorter lateral extent than the clip or card-flat bar, the length of a segment preferably amounting to less than half the length of the clip or card-flat bar. The clip is in this case opened segmentally. Opening takes place only in the segment which is covered by the device or its spike. After the opening of the clip in the segment which is covered by the spike, the lever is returned to its initial position. The device can then be displaced on the card-flat bar by the amount of a segment length. In this case, the device does not have to be removed from the card-flat bar. The device does not have to be laid in place anew for each segment, but, instead, is arranged displaceably on the card-flat bar owing to the combination of the bearing face and retainer.

Various types of construction of clips for fastening clothing strips on card-flat bars are known from the prior art. A card-flat bar is mostly designed in such a way that it consists of a card-flat foot and of a web integrally formed on the latter. A clothing strip is laid in place on that side of the card-flat foot lying opposite the web and is held on the card-flat bar by means of the clips. A very popular type of construction of clips is one in which the clips are bent around over the card-flat foot and integrally formed onto the latter. In this case, the clips are led around the card-flat foot in such a way as to give rise to a bracketing of the card-flat foot. The bracketing is in this case closed to a greater or lesser extent, depending on the design of the card-flat foot. That surface of the card-flat foot which lies opposite the clothing strip has a mostly inclined design. If this surface is inclined towards the web, a highly bent bracketing is obtained, which is also designated as crimping. If the surface is inclined away from the web, a less bent bracketing is obtained, which is more open. Types of construction are also known in which ribs are integrally formed onto the web on the card-flat bar above the card-flat foot. The clips used for fastening the clothing strip to the card-flat bar in this case do not bracket the card-flat foot, but, instead, these integrally formed ribs. In this case, too, a highly bent bracketing (crimping) or a less bent bracketing of the rib is possible, depending on the type of inclination of the surface of the rib. If a clip is led from the clothing strip over the card-flat foot as far as a rib lying above the card-flat foot, the result of this is that a depression located between the card-flat foot and the rib is spanned by the clip.

In the event that the clip to be opened spans a depression on the card-flat bar, the spike of the device according to the invention is oriented such that a portion of the clip which spans the depression is pressed into the depression by the spike as a result of the movement of the lever. As a result of this deformation of the clip, the spanning of the clip causes the bracketing of the card-flat bar to open. The device is consequently pushed further on by the amount of a segment length and the opening operation is repeated. The clip is thus opened over its entire length, a segment length corresponding to the length which can be opened in one operation by the spike used. The segment length, that is to say the width of the spike to be used, is to be selected such that it is possible for the device to be operated by hand. Operating the device by hand makes a particularly careful procedure possible. The spike is held at a centre of rotation and is moved via a lever. On account of the lever force and by virtue of a corresponding design of the lever lengths and the choice of the segmented length, sufficiently high forces can be applied in order to open the clip, even in manual operation.

If the clip is fastened to the card-flat foot in such a way that it does not span any depression, with the device according to the invention being designed correspondingly it is then possible to open the clip in that the portion of the clip. The clip, which is integrally formed on the card-flat bar, on the surface lying opposite the clothing strip, is stripped off from the card-flat bar. The spike is oriented such that is engages the end of the clip on the narrow side of the latter. The end of the clip is moved outwards by the spike as a result of the movement of the lever over that surface of the card-flat foot on which the clip lies. By virtue of this movement, the clip is opened. As a result, the device is displaced on the card-flat bar by the amount of a segment length, and the operation is repeated.

If, even if a clip not spanning a depression is used, a rib is nevertheless arranged on the card-flat bar or the web and projects from the card-flat bar over the entire length of the latter, this rib may be utilized for hooking up the retainer. In this type of construction, that part of the card-flat bar around which the retainer engages, corresponds to the rib projecting from the web. In this type of construction, it is not necessary to engage around the card-flat bar over and beyond the clothing strip onto that side of the card-flat bar which lies opposite the clip to be opened.

When a clip is opened over its entire length, the device can be lifted off from the card-flat bar and the clothing strip removed from the card-flat foot. Depending on the type of construction of the card-flat bar and of the clip used, it may be sufficient to open the clip located on one side of the card-flat bar. If a plurality of clips are used on one side of the clothing strip, before the clothing strip is removed all the clips on this one side must be opened. After the opening of the clips, the clothing strip can be removed, together with the clips fastened to it, from the card-flat foot, without damage to the bearing face, provided for the clothing strip, of the card-flat foot.

In a further development of the device according to the invention, the lever for moving the spike is replaced by a drive. A refinement also involves a drive for displacing the device on the card-flat bar. Possible drives are, for example, electric motors or hydraulic drives. The movements may also be intensified by means of energy accumulator elements, for example by springs or gas-pressure elements.

If the device is provided in its type of construction as a machine which makes it possible to draw off clothing strips from card-flat bars automatically or by manual operation, without a displacement of individual segments on the card-flat bar being necessary, inserting the card-flat bar into the device is equivalent to laying the device in place on the card-flat bar.

BRIEF DESCRIPTION OF THE DRAWINGS

The invention is explained below by means of exemplary embodiments and by means of drawings in which.

DETAILED DESCRIPTION OF THE INVENTION

Figure 1:
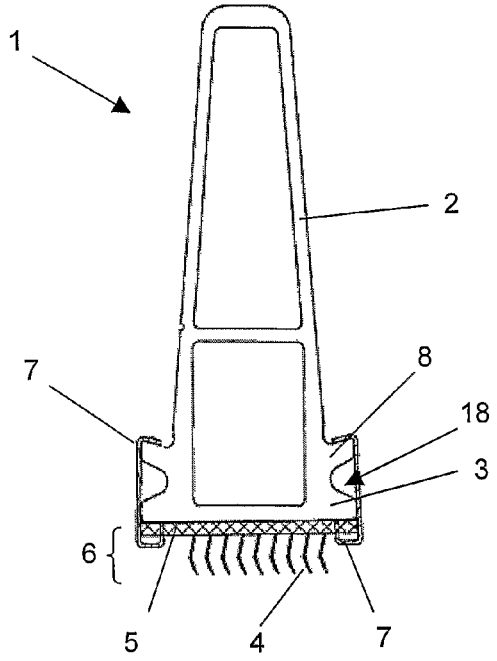
FIGS. 1 and 2 show a diagrammatic illustrations of various forms of construction of a card-flat bar.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
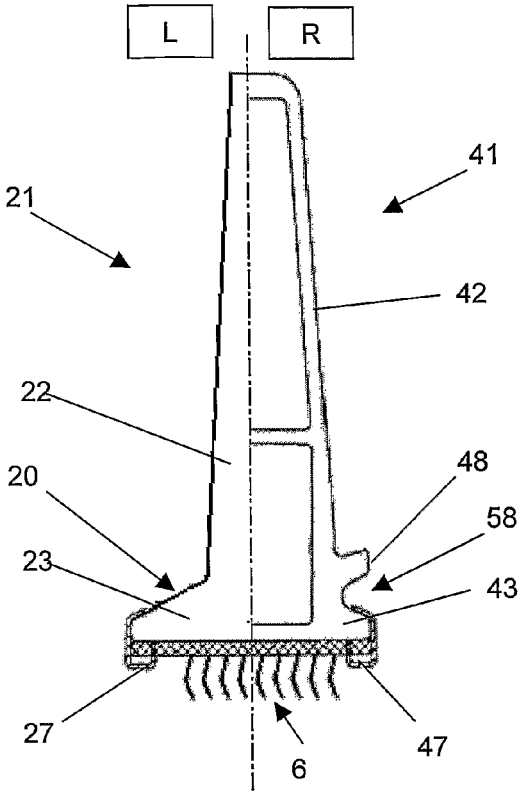

FIGS. 1 and 2 show diagrammatic illustrations of cross sections of various forms of construction of card-flat bars and are to serve for explaining possible types of construction and fastenings of clothing strips on card-flat bars.

FIG. 1 shows a card-flat bar 1 which has been manufactured as a hollow profile. The card-flat bar 1 comprises a card-flat foot 3 and a web 2. A rib 8 is integrally formed on the web 2 on both sides of the latter. The rib 8 runs over the entire length of the card-flat bar 1 and with the adjacent card-flat foot 3 forms a depression 18. A clothing strip 6 is attached that side of the card-flat foot 3 which les opposite the web 2. The clothing strip 6 consists of a foundation 5 and of clothing elements held in the latter, such as, for example, the small wire hooks 4 illustrated. The clothing strip 6 is fastened on its longitudinal sides to the card-flat foot 3 by means of clips 7. The clips 7 are held in the foundation 5 of the clothing strip 6 and extend beyond the card-flat bar 3 to over the rib 8. In this case, the clip 7 spans the depression 18. The clothing strip 6 is thereby retained on the card-flat bar 1 in a clamp-like manner.

FIG. 2 shows, in the right-hand half, designated by R, of its illustration, a card-flat bar 41 which is similar to that in FIG. 1. The card-flat bar 21 likewise has a card-flat foot 43, a web 42 and a rib 48 integrally formed onto the web 42. The clothing strip 6 is also of the same type of construction as the clothing strip 6 shown in FIG. 1. This consists of flexible multi-layer fabrics 5 which are normally used in revolving card flats and are equipped with small wire hooks 4. The clothing strip 6 is likewise held on each side of the card-flat foot 43 by means of clips 47. In contrast to FIG. 1, however, the clip 47 does not span the depression 58. The clip 47 fits snugly against the card-flat foot 43 and does not extend beyond the card-flat foot 43, as is the case when the depression 58 is spanned.

A further type of construction of card flats 21 is illustrated in FIG. 2 in the left-hand half, designated by L, of the illustration. The card-flat bar 21 has a card-flat foot 23 and a web 22, but is not shaped as a hollow profile. The card-flat bar 21 is illustrated as a solid profile, and also the web 22 has not integrally formed rib similar to the rib 48. The fastening of the clothing strip 6 to the card-flat foot 23 is designed in a similar way to the illustration in the right-hand half of FIG. 2. The inclination of that surface 20 of the card-flat foot 23 onto which the clip 27 is integrally formed is selected randomly in FIG. 2. It is also conceivable that the surface 20 is inclined downwards, that is to say in the direction of the clothing strip 6, with respect to the web 22.

Figure 3:
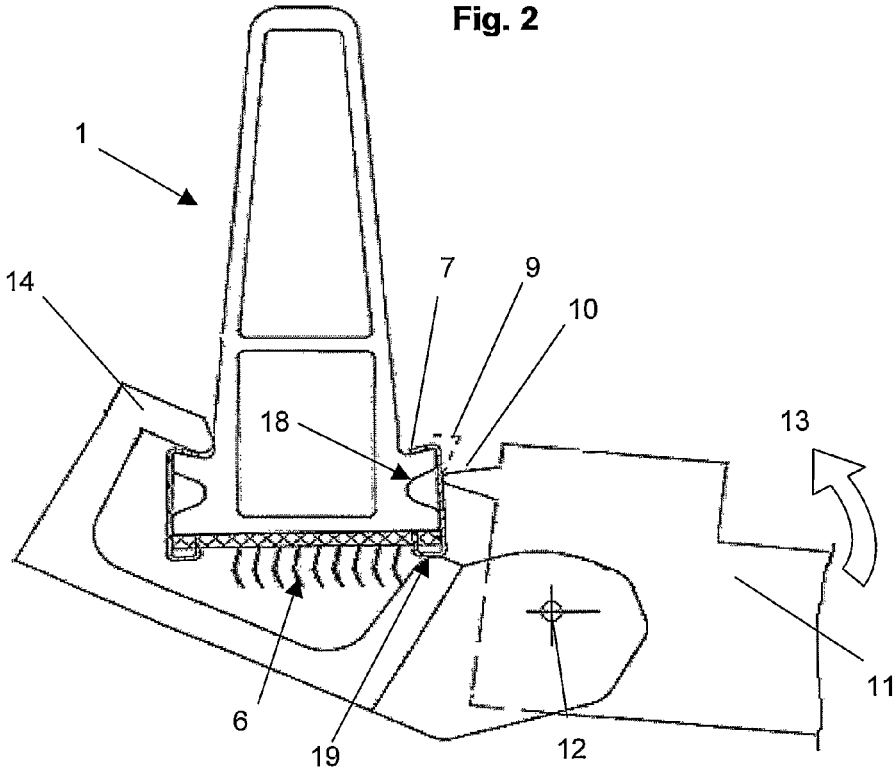
FIG. 3 shows a diagrammatic illustration of a cross section of a first device according to the invention.

FIG. 3 shows a diagrammatic illustration, in cross section, of a first device embodiment according to the invention for drawing off a clothing strip 6 from a card-flat bar 1. The card-flat bar 1 shown, together with the clothing strip 6 fastened to it, corresponds to the card-flat bar 1 according to FIG. 1. The device has a bearing face 19 and a retainer 14. The bearing face 19 is firmly connected to the retainer 14 and forms a first unit. Attached to this first unit via a centre of rotation 12 is a spike 10 which with a lever 11 forms a second unit. The device is hooked on the card-flat bar 1 by means of the retainer 14 on the side lying opposite the lip 7 to be opened and is laid with its bearing face 19 against the clip 7 to be opened. When the device is applied, the retainer 14 and the bearing face 19 gives rise to a lever action, and therefore no further fastening of the device to the card-flat bar is necessary. The retainer 14 in this case engages around the clothing strip 6 over the rib 8 running longitudinally along the card-flat bar 1. As a result of a movement of the lever 11 in the direction 13 towards the card-flat bar 1, an application of the spike 10 to the clip 7 to be opened is achieved. As a result of a continued movement of the lever 11 in the direction of the arrow 13, that part of the clip 7 which is located above the depression 18 is pressed by the spike 10 into this depression 18. The result of this is that that part of the clip 7 which is bent around the rib 8 is opened. The clip 7, at its end lying above the rib 8, is bent open beyond the rib 8 as a reaction to the pressing-in of the portion of the clip 7 via the depression 18 by means of the spike 10. The opened part of the clip 7 above the rib 8 is illustrated by the dashed line 9 in FIG. 3. The opening of the clip 7 in this case takes place only over the length of the spike 10 which is illustrated by way of example as an elongate tapering batten. When the clip is opened over its entire length, the clothing strip 6, together with the clips 7 fastened to it, can be removed from the card-flat bar 1, without the need for the clothing strip 6 to be peeled out from the clips 7.

Figure 4:
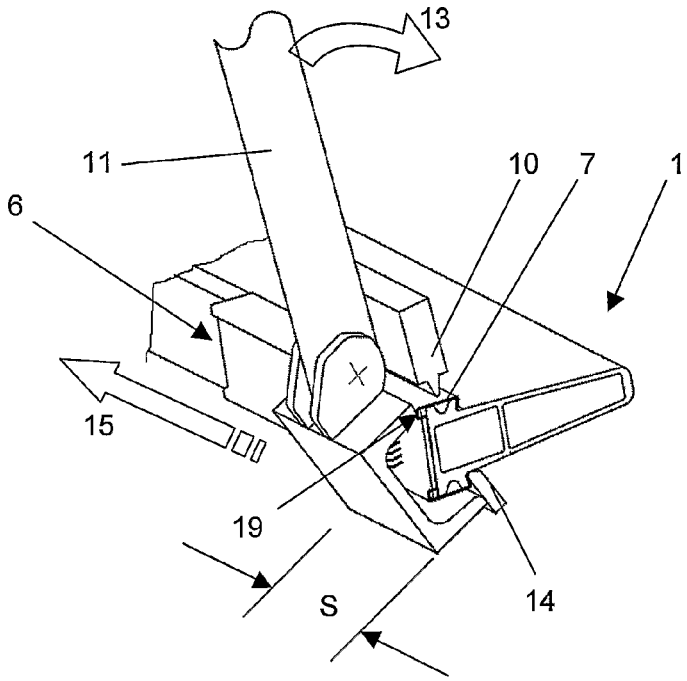
FIG. 4 shows a three-dimensional illustration of the first device according to the invention.

FIG. 4 shows the same first device according to the invention as FIG. 3, but in a diagrammatic three-dimensional view. The device has a segment length S which is smaller than half the length of the clip 7 to be opened. The segment length S is to be selected in such a way that a manual operation of the lever 11 makes it possible to have a deformation of the clip 7. After the retainer 14 is hooked on and the bearing face 19 bears against the clip 7, the clip 7 is pressed into the depression 18 by the spike 10 as a result of the movement of the lever 11 in the direction of the arrow 13 to an extent such that the clip 7 opens. However, this opening takes place only within the segment length S. When the clip 7 is opened over the length of the segment S, the lever 11 is brought into the initial position, and the device is raised, so that the bearing face 19 is released from the clip 7. The device is then freely to be displaced further on along the card-flat bar 1 by the amount of a segment length S (direction of the arrow 15) and is to repeat the operation in a second segment. In the illustration of FIG. 4, the bearing face 19 and also the retainer 14 are shown by way of example as leading over the entire length S of the segment. For a functioning of the device, it is not necessary that the bearing face 19 bears against the clip 7 over the entire length S or that the retainer is hooked on the card-flat bar over the entire length S. It is sufficient if the length of the bearing face 19 and of the retainer 14 amounts to part of the segment length S. The length and the size of the bearing face 19 and retainer 14 are to be selected such that no damage to the card-flat bar 1 or to its surfaces occurs as a result of the introduction of the retention force into the card-flat bar during the pressing operation. Furthermore, it is also conceivable to execute the movement 13 of the lever 11 by means of a drive.

Figure 5:
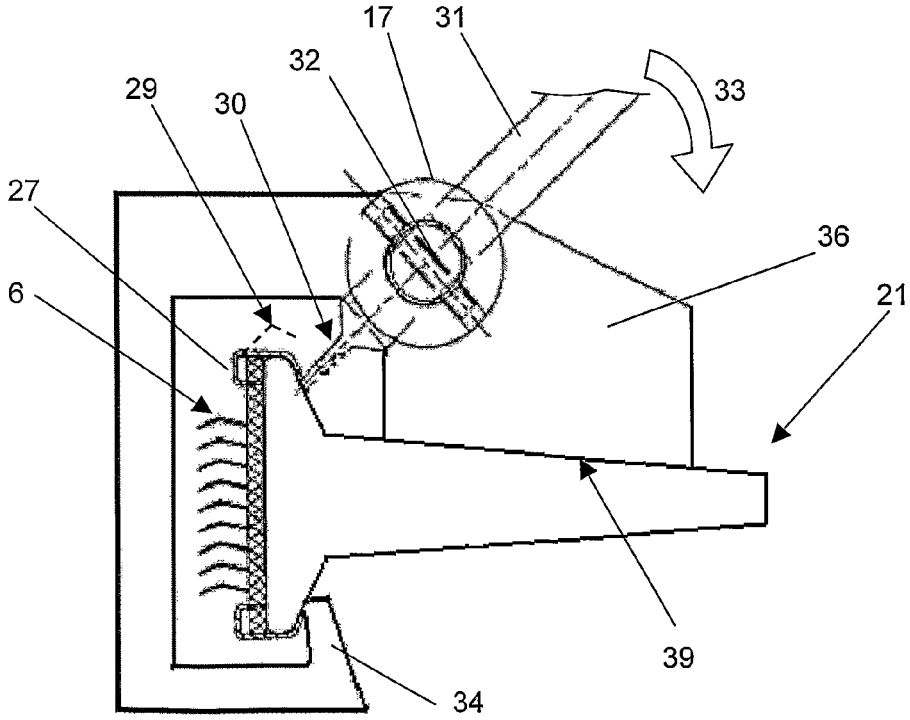
FIG. 5 shows a diagrammatic illustration of a cross section of a second device according to the invention.

FIG. 5 shows a diagrammatic illustration, in cross section, of a second device embodiment for drawing off a clothing strip 6 from a card-flat bar 21. The card-flat bar 21 shown, with the clothing strip 6 fastened to it, corresponds to the card-flat bar 21 according to FIG. 2 in the left-hand half L of the illustration. The device likewise has a bearing face 39 and a retainer 34. The bearing face 39 and retainer 34 are firmly connected to one another and are joined together via a centre of rotation 32 by means of a spike 30 and an associated lever 31 to form the device. The retainer 34 and the bearing face 39 form a unit which is preferably manufactured from two metal sheets as two side plates 36. The side plates 36 are connected, spaced apart from one another, to a shaft 17. The shaft 17 is mounted rotatably and serves as a receptacle for the spike 30 and for the lever 31 connected to the spike. The device is hooked on the card-flat bar by means of the retainer 34 on the side lying opposite clip 27 to be opened and is laid with its bearing face 39 on the card-flat bar 21. The retainer 34 in this case engages around the clothing strip 6 over the card-flat foot 23. As a result of a movement 33 of the lever 31, the clip 27 is gripped on its narrow side and is stripped off from the card-flat bar 21. By virtue of this stripping-off movement, the clip 27 is bent open. The opened clip 27 is illustrated in FIG. 5 as a dashed line 29. When the clip is opened over its entire length, the clothing strip 6, together with the clips 27 fastened to it, can be removed from the card-flat bar 21, without the need for the clothing strip 6 to be peeled out from the clips 27.

Figure 6:
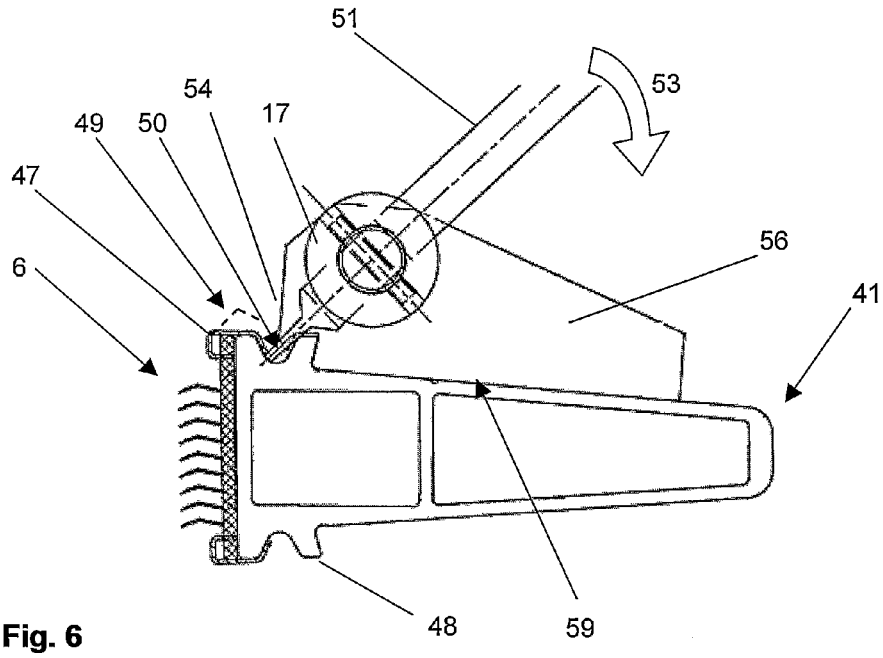
FIG. 6 shows a diagrammatic illustration of a cross section of a third device according to the invention.

FIG. 6 shows a diagrammatic illustration, in cross section, of a third device embodiment according to the invention for drawing off a clothing strip 6 from a card-flat bar 41, which is similar to the device according to FIG. 5. In contrast to the device according to FIG. 5, in the device according to FIG. 6, the retainer 54 is not led around the clothing strip 6. The retainer 54 is hooked in via the rib 48 integrally formed on the web 42 of the card-flat bar 41, that rib 48 being utilized which is arranged on the same side of the card-flat bar 41 as that on which the bearing face 59 is laid in place and the clip 47 to be opened is located. The other elements and the use of the device according to FIG. 6 are identical to the statements made with regard to FIG. 5.

Figure 7:
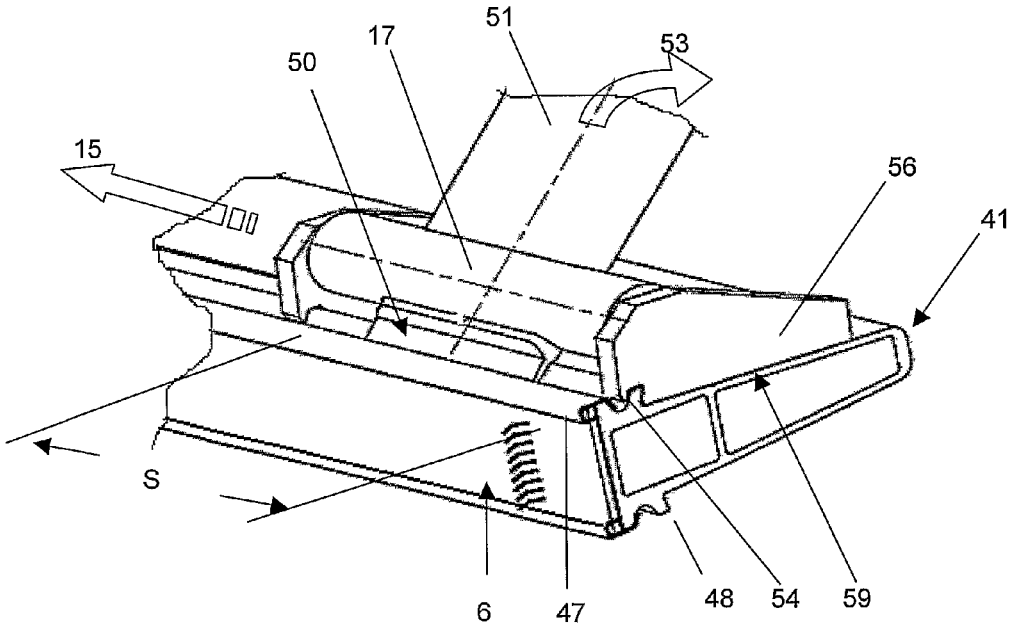
FIG. 7 shows a three-dimensional illustration of the third device according to the invention.

FIG. 7 shows the same third device according to the invention as FIG. 6, but in a diagrammatic three-dimensional view. The device has a segment length S which is smaller than half the length of the clip 47 to be opened. The segment length S is to be selected in such a way that manual operation of the lever 51 makes it possible to have a deformation of the clip 47. After the retainer 54 is hooked on the rib 48 and the bearing face 59 bears on the card-flat bar 41, the clip 47 is stripped off from the card-flat bar by the spike 50 as a result of the movement of the lever 51 in the direction of the arrow 53, the clip 47 is opened. However, this opening takes place only within the segment length S. When the clip 47 is opened over the length of a segment S, the lever 51 is brought into the initial position, and the device is displaced on the card-flat bar 41 in the direction of the arrow 15 by the amount of a segment length S. The operation is to be repeated in a further segment.

Furthermore, it is also conceivable to execute the movement 13 of the lever 11, 31, 51 by means of a drive in the devices of FIGS. 3 to 7. A further version of the invention may also have a driven movement 15 (FIG. 7) of the device. Drives used may be electric or hydraulic drives. In the case of a drive of the movement 13, 33, 53 of the lever 11, 31, 51, in accordance with the higher force of the drive, correspondingly longer segments S may be used, in contrast to a manual operation.

If the length of a segment S is greater, according to the weight of the device, the device must not be laid against the card-flat bar 1, 21, 41, but, instead, the card-flat bar 1, 21, 41 must be introduced into the device.

Modifications and variations can be made to the embodiments illustrated or described herein without departing from the scope and spirit of the invention as set forth in the appended claims.

The invention claimed is:

1. A device for drawing off a clothing strip from a card-flat bar, the clothing strip being held on the card-flat bar by fasteners in the form of clip or clamp-like members, the device comprising:

a bearing face configured for engagement against the card-flat bar or fastener on a side of the card-flat bar having the fastener intended to be removed;

a retainer spaced from the bearing face and configured for engagement against another component or portion of the card-flat bar such that the card-flat bar is retained between the bearing face and the retainer; and a spike pivotally mounted relative to the bearing face and configured to engage and open the fastener intended to be removed away from the card-flat bar upon pivotal movement of the spike.

2. The device according to claim 1, wherein the spike consists of at least one segment, and wherein the length of the spike segment is less than half the longitudinal length of the fastener intended to be removed from the card-flat bar.

3. The device according to claim 2, wherein the length of the spike segment is such that the device can be operated by hand.

4. The device according to claim 1, wherein the retainer is configured so as to engage at least partially around the card-flat bar, and the spike has a shape that is coordinated with the type of construction of the clip to be opened.

5. The device according to claim 4, wherein the retainer is configured to engage against a rib formed on a web component of the card-flat bar.

6. The device according to claim 1, wherein the spike is connected to a lever that rotates to engage the spike against the fastener.

7. The device according to claim 1, wherein the device is displaceable longitudinally along the card-flat bar for opening defined longitudinal sections of the fastener along the card-flat bar.

8. A method for drawing off a clothing strip from a card-flat bar, the clothing strip being held on the card-flat bar by fasteners in the form of clip or clamp-like members, the method comprising sequentially engaging and deforming defined longitudinal sections of the fastener along one longitudinal side of the card-flat bar such that the fastener opens and disengages from the card-flat bar along the longitudinal side.

9. The method according to claim 8, wherein a device is hooked onto the card-flat bar and a pivotal spike on the device is used to engage and deform the fastener along the defined longitudinal section.

10. The method according to claim 8, wherein the fastener is crimped onto the card-flat bar, the method comprising engaging and deforming the fastener at a middle portion by pressing the middle portion into a depression in the card-flat bar, thereby causing the crimped portion to disengage and move away from the card-flat bar.

11. The method according to claim 8, wherein a portion of the fastener is stripped from the card-flat bar along a surface lying opposite the clothing strip.

* * * * *